United States Patent [19]

Ambler

[11] 4,276,997

[45] Jul. 7, 1981

[54] DISPENSING APPARATUS FOR AN AIRCRAFT ANTI-ICING AND BIOCIDAL FUEL ADDITIVE

[76] Inventor: Theodore C. Ambler, 727 S. Washington, Casper, Wyo. 82601

[21] Appl. No.: 930,570

[22] Filed: Aug. 3, 1978

[51] Int. Cl.[2] ..... B67D 5/06

[52] U.S. Cl. ..... 222/23; 222/39; 222/41; 222/57; 222/145

[58] Field of Search ..... 137/101.21, 101.19; 222/14, 23, 52, 57, 71, 74, 76, 145, 399, 39, 41

[56] References Cited

U.S. PATENT DOCUMENTS

| | | | |
|---|---|---|---|
| 2,732,069 | 1/1956 | Henderson | 137/101.21 |
| 3,283,957 | 11/1966 | Henderson | 222/57 |
| 3,448,754 | 6/1969 | Crabtree | 222/57 |
| 3,454,027 | 7/1969 | Friedman | 137/101.21 |
| 3,882,882 | 5/1975 | Preisig | 222/57 |
| 4,004,714 | 1/1977 | Ito et al. | 222/41 |

FOREIGN PATENT DOCUMENTS

| | | | |
|---|---|---|---|
| 870876 | 5/1971 | Canada | 222/57 |
| 740843 | 11/1943 | Fed. Rep. of Germany | 137/101.21 |

*Primary Examiner*—H. Grant Skaggs
*Attorney, Agent, or Firm*—Max L. Wymore

[57] ABSTRACT

An additive metering and dispensing system for the addition of an additive to aircraft fuel which includes a variable volume regulator for measuring and dispensing the additive, the volume of which can be varied during a dispensing cycle.

4 Claims, 2 Drawing Figures

DISPENSING APPARATUS FOR AN AIRCRAFT ANTI-ICING AND BIOCIDAL FUEL ADDITIVE

Figure 1:
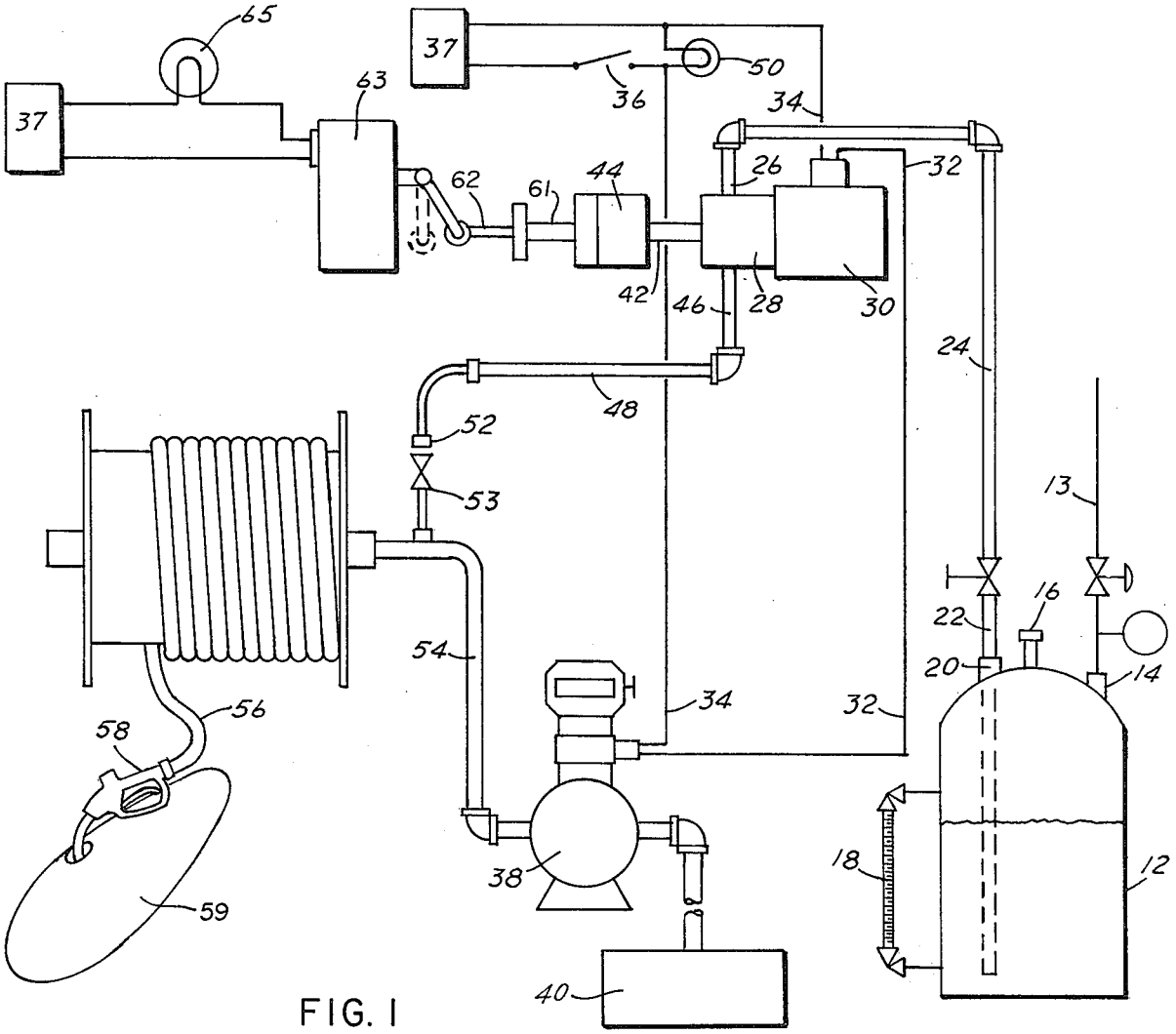

Aircraft and particularly high flying jet aircraft have great difficulty with the presence of even minute amounts of moisture in the fuel. Fuel system and/or carburetor icing has always been a serious threat to the safety of flying. Ever since the day that Wilbur Wright proved that man could fly, instructors have drilled into their fledgling pilots the disaster of fuel system or carburetor icing. The most dangerous is carburetor icing which can cause total power failure. Means were devised to combat this problem by providing heat to the carburetor and these were effective when engines are running, when sufficient heat is generated, when time is sufficient to melt the ice and the pilot remembers to use it.

When the jet aircraft became a common part of the scene, the problem became compounded since the jets fly higher, faster and further and icing became even more of a problem. All aircraft fuels, jet or reciprocating, contain some dissolved water. This is a physical characteristic of hydrocarbons and is an accepted fact, regardless of precautions taken during fuel transportation and storage. Not only does all fuel contain some dissolved water, but as fuel is consumed in flight, moisture-laden air replaces it in the fuel tanks. Then as fuel and tank surfaces cool at high altitude, the moisture condenses as tiny droplets and accumulates.

It is a characteristic of the denser, high viscosity fuels used in jet and turbo-prop aircraft, as compared to aviation gasoline, that free water will suspend in it longer before the water settles out. As jet aircraft cruises many miles above the earth, where the temperature is artic both summer and winter, the water entrained in their fuel becomes super-cooled. When the super-cooled droplets of water strike an obstruction, such as a fuel filter, ice crystals can form. As these ice crystals build up on the obstruction, they can clog filters and obstruct fuel flow with the result that the planes would experience power loss, engine surge, lack of throttle control and even engine flame out. Jet aircraft malfunctioning because of fuel system icing was a serious problem for commercial and military aircraft alike. Where applicable, corrective measures such as fuel heaters were first used. Then a concerted effort of industry was made to develop a remedy to provide protection all the way from the fuel tank to the burner can nozzles. Over 200 chemicals were offered as possible solutions and one additive developed by Phillips Petroleum Company and code named PFA 55MB proved by far to be the best for all around operation. This additive was a two component blend of ethylene glycol monomethyl ether and glycerol which is the subject of MIL-J-5624 jet fuel specification which requires that all JP-4 fuel purchased by the air force contain the PFA 55MB additive in concentrations from 0.10 to 0.15 volume percent. The fuel additive which is known under the trademark PRIST manufactured by Houston Chemical Company is made up of 99.6±0.04 weight percent of glycerol.

The inclusion of PRIST in turbine fuel has no measurable effect on the physical characteristics of the fuel itself other than to depress the moisture freeze point of the fuel. The additive is soluble in jet fuel from 30 to 100 times its recommended concentration from 0.05 to 0.15 volume percent, and is completely soluble in any water entrained in, or rejected from, the fuel. Because of its limited solubility in jet fuel, however, the additive demands incremental blending into fuel. It is necessary to blend the additive into the fuel at the time of refueling, with the turbulence of the flowing fuel stream providing additional mixing action.

To be fully effective, both as an anti-icing and biocidal agent, the additive must be proportioned into the fuel of the aircraft. It should not be dumped into the fuel or into the fuel tank of the aircraft under any circumstances and the additive must be present in the fuel that goes into the aircraft at every refueling. Because most refueling bases do not have the additive available, preblended, in the fuel they offer for sale, it has been the practice heretofore to provide portable dispensers of the additive that can be carried aboard the aircraft. One such dispenser is of the aerosol variety and the user sprays the additive into the fuel tank while the fuel is added. Another is a repressurable proportioner which is pressurized from a local source of air under pressure and acts as a propellant to dispense the additive into the fuel at the time of refueling.

It is an object of the present invention to provide an additive dispensing system for the dispensing of an additive into a fuel stream being added to the tanks of an aircraft.

It is a further object of the present invention to provide an improved metering and dispensing system to introduce metered amounts of an additive to aircraft fuel at the time of refueling.

It is a still further object of the present invention to provide an improved metering and dispensing system which is more economical, highly reliable and easy to use which provides signal means to alert the operator of proper operation.

A still further object of the present invention is to provide an improved volume regulator suited to the system.

The present invention is directed to a system including a storage tank adapted to be pressurized containing an additive, a small portion of which is to be added or introduced into a much larger flowing stream of a fluid such as jet fuel for aircraft. The outlet of the additive storage tank selectively communicates via a three-way valve to a volume regulator adapted to receive a measured amount of additive. The volume regulator effectively stores a small amount of additive and is selectively connected via the three-way valve to discharge or meter the additive into a flowing stream of fluid with the three-way valve being actuated as a function of a meter measuring delivery of the fuel. The calibrated sight glass 18 on the additive storage tank 12 provides a primary means of observing the flow of additive into the fuel stream by the operator visually checking the calibrated sight glass before and after loading of the fuel to determine the amount of additive added to the fuel. The operation of the volume regulator may also be such that a signal, either visual and/or audible is generated so the operator is advised of the operational status of the system. A secondary means of checking calibration is provided by a disconnect in the line from the three-way valve to the metered fuel such that the amount of additive being injected can be checked while the fuel pumped during the check is returned to the fuel supply tank. The entire system is conveniently mounted on a fuel tank truck for ease of use.

Other and further objects will become apparent upon an understanding of the following specification or will occur to one skilled in the art upon employment of the invention in practice.

Figure 2:
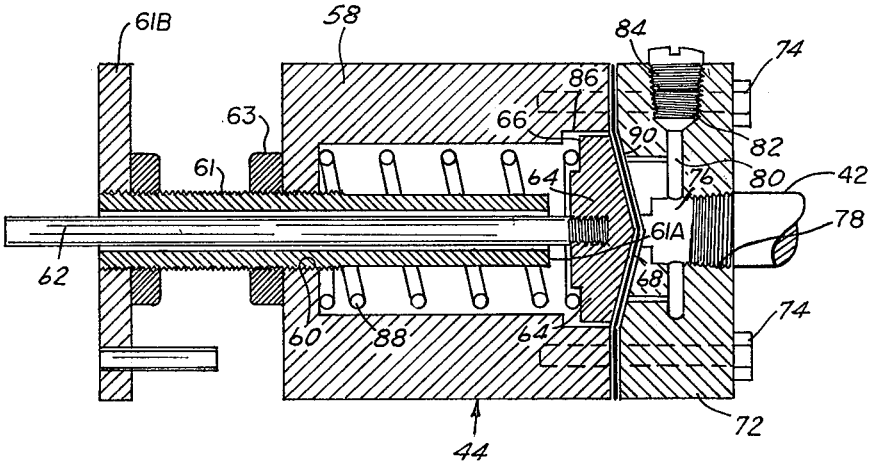

A preferred embodiment has been chosen for illustrating the invention and is shown in the accompanying drawings in which:

FIG. 1 is a schematic representation of the system of the present invention; and, FIG. 2 is a cross sectional view of the volume regulator used in the system.

Referring to FIG. 1, the additive metering system is generally represented by reference numeral 10 and is provided with a storage tank 12 adapted to be put under pressure such as that from a service air supply line 13. The tank 12 is provided with an air inlet 14 and an additive inlet 16 and preferably a sight glass 18 to display the additive level. In addition, the tank 12 is provided with an additive outlet 20 into which a standpipe 22 is positioned. The standpipe 22 may be connected to the feed pipe 24 via a valve 26 and the feed pipe is connected to an inlet 26 of a three-way valve 28. Valve 28 is provided with an electrical solenoid 30 having a pair of leads 32 and 34 to which a current may be supplied.

The leads 32 and 34 are connected via switch 36 with a source of voltage 37 and in series with an impulse contactor driven by a fuel meter 38 which produces a contact closure and actuation of the solenoid 30 each time the meter 38 registers one gallon of fuel passing from the tank 40 of a fuel tank truck, not shown, on which the system is mounted.

With the solenoid unactuated, three-way valve 28 connects additive inlet 26 to the inlet 42 of the volume regulator 44. A charge of additive is thus received by the volume regulator from the storage tank 12. The meter 38 receives fuel from the truck tank 40 pumped by a suitable pump. As each measure of fuel, such as a gallon, passes through meter 38, a contact closure is experienced and solenoid 30 is energized. A light 50 is positioned across the supply voltage for the solenoid to indicate when switch 36 is in the on position. When solenoid 30 is actuated, the inlet 42 of the volume regulator via the three-way valve 28 is connected to the outlet 46 of the three-way valve and into line 48. Line 48 is provided with a quick disconnect 52, for the purpose to be described. The line 48 feeds into the line 54 connected to the outlet of meter 38 which is connected to a reeled fuel hose 56 and nozzle 58 for dispensing the fuel from the fuel truck into the aircraft 60. Thus, each time the meter 38 sends an impulse to the three-way valve solenoid 30, there is injected a small portion of fuel additive into the fuel line 54 for delivery by hose 56 into the aircraft fuel tanks.

Referring now to FIG. 2, there is shown in cross section the volume regulator 44 which is comprised of a cup-shaped body 58 having a threaded opening 60 in the bottom thereof receiving a threaded sleeve 61 through which a rod 62 passes in sealed relation. The end of the rod 62 within the interior of body 58 is threadedly connected to a piston 64. The body 58 at the open end is provided with a slightly larger diameter recess 66 for a short distance from the open end and the piston is of a diameter to be received within this recess which acts as a stop for movement of the piston into the inside of body 58 or to limit movement to the left in FIG. 2. The inner end 61A of sleeve 61 may serve as an adjustable stop for leftward movement of piston 64 intermediate the extreme left stop formed by shoulder 66 and extreme rightward stop afforded by cap or head 72. Threaded sleeve 61 is provided with a locknut 63 to hold the sleeve and stop 61A in a selected position with respect to body 58. It will be appreciated that the sleeve 61 and stop 61A can be adjusted to any point in the filling cycle to change the amount of additive to be delivered per unit of fuel during the loading cycle of the aircraft. A calibrated wheel 61B may be secured by suitable means to sleeve 61 to indicate the delivery rate of the additive.

The top 68 of piston 64 is of conical configuration and a diaphragm 70 of flexible material covers the top of the piston and is clamped at its edges by a cap or head 72 that is secured to the body in fluid tight relation by fastening means such as bolts 74. The head 72 is provided with a central bore 76 aligned with piston rod 62 with the outer portion of the bore being threaded as at 78 to mate with a pipe such as inlet pipe 42, FIG. 1. The head may also be provided with a cross bore 80 intersecting bore having a threaded outer portion 82 to receive a plug 84.

The bottom of the piston 64 is provided with a shoulder 86 against which a spring 88 urges the piston and the diaphragm 70 into contact with the cap or head 72. The portion of the head opposite the piston 64 is provided with a mating conical portion 90 which is shown to be concave. In operation, the additive is fed under pressure from storage tank 12 via pipe 24 and three-way valve 28 and inlet 42 threadedly connected to bore 76 via threads 78 of the volume regulator 44. The additive under pressure acts against the diaphragm 90 and the piston 64 to compress spring 88 of the travel distance allowed the piston by shoulder 66 of body 58. When a pulse is received from the meter 38, as a result of fuel being metered thereby, and applied to solenoid 30 of three-way valve 28, the volume regulator 44 is connected to release the additive received thereby via inlet 42 to outlet 46 and through pipe 48 into pipe 58 and the fuel being delivered to the tanks 59 of an aircraft via hose 56 and nozzle 58. The travel of piston 64 and diaphram 90 to the left in FIG. 2 will determine the amount of additive metered by volume regulator 44. The stop 66 determines the maximum delivery while adjustment of sleeve 61 with respect to body 58 and piston 64 will determine selected intermediate delivery amounts. The locknut 63 provides for securing sleeve 61 in a predetermined position and the adjustment of sleeve 61 during a refueling cycle and the amount of additive being delivered is easily accomplished. Since the piston rod 62 will be reciprocating with each measure of additive delivered, a switch 63 may be actuated thereby to energize a lamp or horn 65 to provide a visual and/or audible signal of such delivery and/or a counter may be actuated to record the measures delivered for comparison with fuel delivered and for inventory purposes to determine status of the additive in the storage 12.

A primary check of the calibration of the system and the amount of additive being added to or delivered with the fuel is accomplished by the operator visually checking the additive level sight glass 18 on the additive storage tank 12 both before and after delivery of the fuel. The quick disconnect 52 provides a secondary means for calibrating the system and to determine the additive delivery. By removing the quick disconnect after closing valve 53, and feeding the nozzle 58 back into the truck tank, fuel can be metered through meter 38 without loss. The pulses will be delivered to solenoid 30 of three-way switch 28 and additive delivered to line 48 for each measure of fuel going through meter 38. The amount of additive collected from the quick disconnect 52 provides a check on the calibration of the system and its operativeness.

What is claimed is:

1. An additive metering and dispensing system including:

an additive storage tank, having inlet and outlet means, adapted to receive an additive under pressure;

a volume regulator, having inlet-outlet means, adapted to receive and dispense through said inlet-outlet means a selected variable measured amount of additive on each operation cycle and wherein the volume regulator has means for selectively varying the amount of additive during the operation cycle;

a three-way valve means having first and second outlet means and an inlet means connected to the outlet means of said storage tank adapted to selectively connect said first outlet means thereof to the inlet-outlet means of the volume regulator in response to a signal and to selectively connect said inlet-outlet means of volume regulator to said second outlet means to deliver thereto a measured amount of additive;

measuring means for measuring a fluid stream to which the additive is to be added;

means connecting said second outlet into the measured fluid stream;

means for developing a signal in response to a predetermined measure of fluid by said measuring means and means for applying the developed signal to the three-way valve to deliver a measured amount of additive to the measured fluid stream in response to the measuring means passing a predetermined amount of fluid.

2. The system according to claim 1 wherein the second outlet means includes a connecting means including a quick disconnect means connecting same to the measured fluid stream.

3. The system according to claim 1 wherein the three-way valve means is solenoid operated and the means for developing a signal connects a source of electrical current to the solenioid as a function of the metering means passing a predetermined measure of fluid.

4. The system according to claim 3 wherein the volume regulator means is adapted to actuate a switch with the delivery of each measured amount of additive is delivered, which switch connects a source of electrical current to a visual or audible signal to notify the operation of the volume regulator.

* * * * *